US006874996B2

(12) United States Patent
Iwanami

(10) Patent No.: US 6,874,996 B2
(45) Date of Patent: Apr. 5, 2005

(54) COMPRESSOR HAVING INDEPENDENTLY DRIVEN MEMBERS

(75) Inventor: Shigeki Iwanami, Okazaki (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/340,805

(22) Filed: Jan. 13, 2003

(65) Prior Publication Data

US 2003/0133809 A1 Jul. 17, 2003

(30) Foreign Application Priority Data

Jan. 15, 2002 (JP) ..... 2002-005969

(51) Int. Cl.[7] ..... F04B 17/00; F04B 49/00; F01C 1/00

(52) U.S. Cl. ..... 417/374; 417/220; 417/338; 417/362; 417/364; 417/420; 417/410.5; 418/173

(58) Field of Search ..... 417/214, 220, 417/217, 316, 338, 362, 364, 374, 420, 410.5; 418/55.1, 173

(56) References Cited

U.S. PATENT DOCUMENTS 1,828,245 A * 10/1931 Davidson ..... 418/173
4,575,318 A * 3/1986 Blain ..... 418/14
4,756,675 A * 7/1988 Kakuda et al. ..... 418/55.3
5,295,808 A * 3/1994 Machida et al. ..... 417/366
5,641,278 A * 6/1997 Tsumagari et al. ..... 418/55.2
6,183,218 B1 * 2/2001 Ojima et al. ..... 417/410.4
6,234,769 B1 * 5/2001 Sakai et al. ..... 417/374
6,375,436 B1 4/2002 Irie et al.

FOREIGN PATENT DOCUMENTS

JP 2-301689 * 12/1990 ..... F04C/18/02
JP 6-101659 * 4/1994 ..... F04C/18/02

* cited by examiner

*Primary Examiner*—Cheryl J. Tyler
*Assistant Examiner*—Timothy P. Solak
(74) *Attorney, Agent, or Firm*—Posz & Bethards, PLC

(57) ABSTRACT

The hybrid compressor apparatus is composed of a compressor in which fluid is compressed by varying a volumetric capacity of a compression space provided between a first compression member and a second compression member, which are movable independently of each other, according to rotation of the first compression member relative to the second compression member, a motor rotatable upon receipt of power of an external electric source, and a driven member rotatably driven by motive force transmitted from an external driving source. The first compression member is connected with the driven member and the second compressor is connected with the motor. If maximum discharge amount is required for the compressor, the motor is driven separately by a control device when the driven member drives the first compression member so that the second compression member is rotated in a direction opposite to that of the first compression member.

10 Claims, 5 Drawing Sheets

COMPRESSOR HAVING INDEPENDENTLY DRIVEN MEMBERS

BACKGROUND OF THE INVENTION

1. Field of the Invention

The present invention relates to a hybrid compressor apparatus, preferably, applicable to a refrigeration cycle system installed in a vehicle having an idle stop mechanism in which an engine stops with temporary stop of the vehicle during its traveling.

2. Description of the Prior Art

Recently, a vehicle incorporating an idle stop mechanism has been put on a market in view of saving fuel consumption. In this vehicle, a compressor for a refrigeration cycle system, driven by an engine, is obliged to stop, when the engine stops with temporary stop of the vehicle during its traveling. Accordingly, the refrigeration cycle system does not work as a cooler during a period when the engine stops.

U.S. Pat. No. 6,375,436 discloses a hybrid compressor apparatus in which the above problem is solved. According to this hybrid compressor apparatus, a pulley to which rotating force of the engine is communicated is linked via an electromagnetic clutch to a compressor and, further, a motor is linked to a rotating shaft of the compressor on a side opposite to the pulley. With this construction, when the engine stops, the electromagnetic clutch is turned off and the motor drives the compressor. Accordingly, the refrigeration cycle system is always operative for performing cooling function irrespective of whether the engine stops or not.

However, in the hybrid compressor apparatus mentioned above, the motor for driving the compressor is used only when the engine stops and is not used as a drive unit during any vehicle traveling conditions.

Capacity of the compressor is decided to meet a maximum thermal load required in the refrigeration cycle system. The thermal load shows a maximum value, typically, at a rapid cooling time (at a cool down time) just after the engine starts in summer season. Accordingly, the capacity of the compressor has to be relatively large to meet the maximum thermal load requirement. In a case that the compressor is driven only by the engine whose operation depends on the vehicle traveling conditions, the larger capacity of the compressor results in a larger body size of the compressor.

SUMMARY OF THE INVENTION

An object of the present invention is to provide a hybrid compressor device whose body is compact.

It is an aspect of the present invention to provide the hybrid compressor apparatus that is operative to secure an adequate cooling function even at a time when the engine stops.

Another aspect of the present invention is to provide the hybrid compressor apparatus that is effectively operated according to various vehicle traveling conditions.

To achieve the above object, the hybrid compressor apparatus is composed of a compressor in which fluid is compressed by varying a volumetric capacity of a compression space provided between a first compression member and a second compression member, which are movable independently of each other, according to rotation of the first compression member relative to the second compression member, a motor rotatable upon receipt of power of an external electric source, and a driven member rotatably driven by motive force transmitted from an external driving source. In the hybrid compressor mentioned above, the first compression member is connected with the driven member and the second compressor is connected with the motor.

It is preferable that the hybrid compressor apparatus has a control device for controlling operation of the motor.

If the driven member drives the first compression member and the control device controls the motor in such a manner that the motor separately drives the second compression member in a rotating direction opposite to that of the first compression member in a normal vehicle traveling, the rotation speed of the first compression member relative to the second compression member increases so that a discharge amount of the compressor increases, compared to that of a conventional hybrid compressor apparatus in which the second compression member is always in state of rest. Accordingly, the compressor of the hybrid compressor apparatus can have a larger discharge capacity with a more compact structure.

On the other hand, if the driven member drives the first compression member and the second compression member is rotated along with the first compression member in the same rotating direction as that of the first compression member and, in this state, rotation amount of the second compression member along with the first compression member is adjusted by the control device that controls induced current to be generated in the motor, the rotation speed of the first compression member relative to the second compression member increases so that the discharge amount of the compressor increases. Accordingly, the discharge capacity of the compressor can be easily changed according to vehicle traveling conditions without using a variable capacity mechanism.

Further, when the external driving source is in a rest state, the driven member is not driven and the first compression member stop. However, at this time, if the motor drives the second compression member, the hybrid compressor can operate to perform continuously the cooling function.

As an alternative, the motor may be provided on a motor shaft thereof with a one-way clutch that allows the motor shaft to rotate only in a rotating direction opposite to that of the driven member.

When the first compression member is moved by the driven member in a state that the motor is turned off, the one-way clutch prevents the second compression member from rotating along with the first compression member so that the compressor is operable as a usual compressor.

In this case, since the induced current is not generated in the motor, the motive force transmitted from the external driving source is not consumed in vain and the induced current control in the motor is not necessary.

Furthermore, in addition to the one-way clutch, an electromagnetic clutch may be provided between the first compression member and the driven member. The electromagnetic clutch serves to permit or interrupt power transmission between the first compression member and the driven member so that a discharge amount of liquid from the compressor is varied by changing operation frequency of the compressor.

It is preferable that the compressor is of a fixed capacity type in which a discharge capacity per rotation of the first compression member relative to the second compression member is fixed to a given value. Accordingly, the compressor itself is inexpensive. Even if the compressor is of the fixed capacity type and not provided with a variable capacity mechanism, the discharge capacity of the compressor can be easily varied by controlling the operations of the motor and the electromagnetic clutch.

Moreover, preferably, the motor has a rotor and a stator on which a coil is wound. Power of the external electric source is applied directly to the coil without a power transmission interface such as a slip ring so that a construction of the motor is simple and inexpensive.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS (First Embodiment)

A first embodiment is described with reference to FIGS. 1 to 4.

Figure 1:
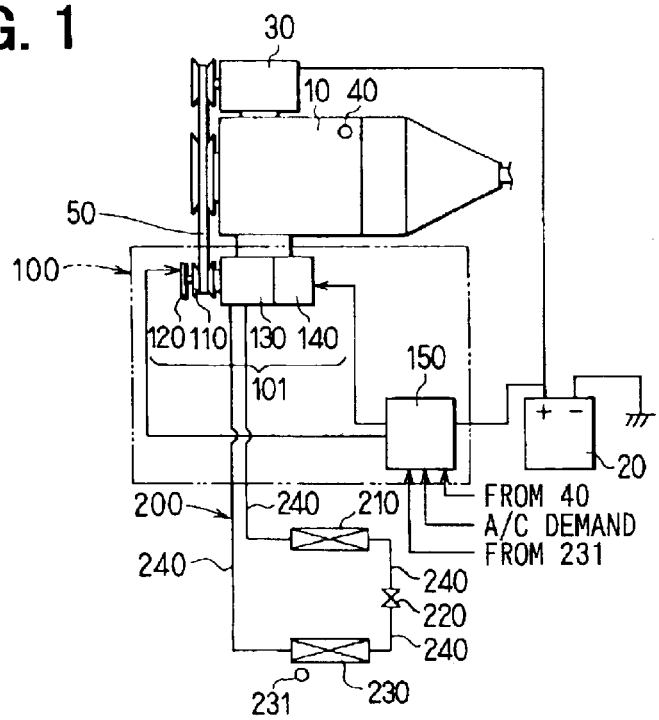
FIG. 1 is a schematic view showing an entire structure of a refrigeration cycle system incorporating a hybrid compressor apparatus according to a first embodiment.

As shown in FIG. 1, A hybrid compressor apparatus 100 is applied to a refrigeration cycle system 200 installed in a vehicle having an idle stop mechanism in which an engine (external driving source) 10 stops with temporary stop of the vehicle during its traveling. The hybrid compressor apparatus 100 is composed of a hybrid compressor 101 and a control device 150 for controlling the hybrid compressor 101. A motor generator 30, which generates current upon receipt of driving force from the engine 10 and charges a battery 20 as an external electric source, and a revolution sensor 40 for detecting revolution number of the engine 10 are mounted on the engine 10.

The refrigeration cycle system 200, which constitutes a known refrigeration cycle, is composed of the hybrid compressor apparatus 100 including the hybrid compressor 101 that has a compressor 130 for compressing coolant within the refrigeration cycle to high pressure and high temperature state, a condenser 210 for condensing the coolant to liquid-phase state, an expansion valve 220 for adiabatically expanding the coolant in the liquid-phase state, and an evaporator 230 for cooling air passing therethrough due to latent heat based on evaporation of the coolant expanded therein. The compressor 130, the condenser 210, the expansion valve 220 and the evaporator 230 are connected in order by coolant pipes 240 to constitute a closed loop circuit. The evaporator 230 is provided on a downstream side of the air passing therethrough with an evaporator temperature sensor 231 for detecting temperature of the air cooled (evaporator backside air temperature Te). A difference between the evaporator backside air temperature Te and a target temperature set by a vehicle passenger for air-conditioning represents thermal load of the refrigeration cycle system 200. As a value of the difference between the evaporator backside air temperature Te and the target temperature is larger, a value of the thermal load of the refrigeration cycle system 200 is larger.

The hybrid compressor 101 is composed of a pulley 110 as a driven member that is driven by the external driving source, an electromagnetic clutch 120 as a power transmission interrupting member, a motor 140 and the compressor 130.

Figure 2:
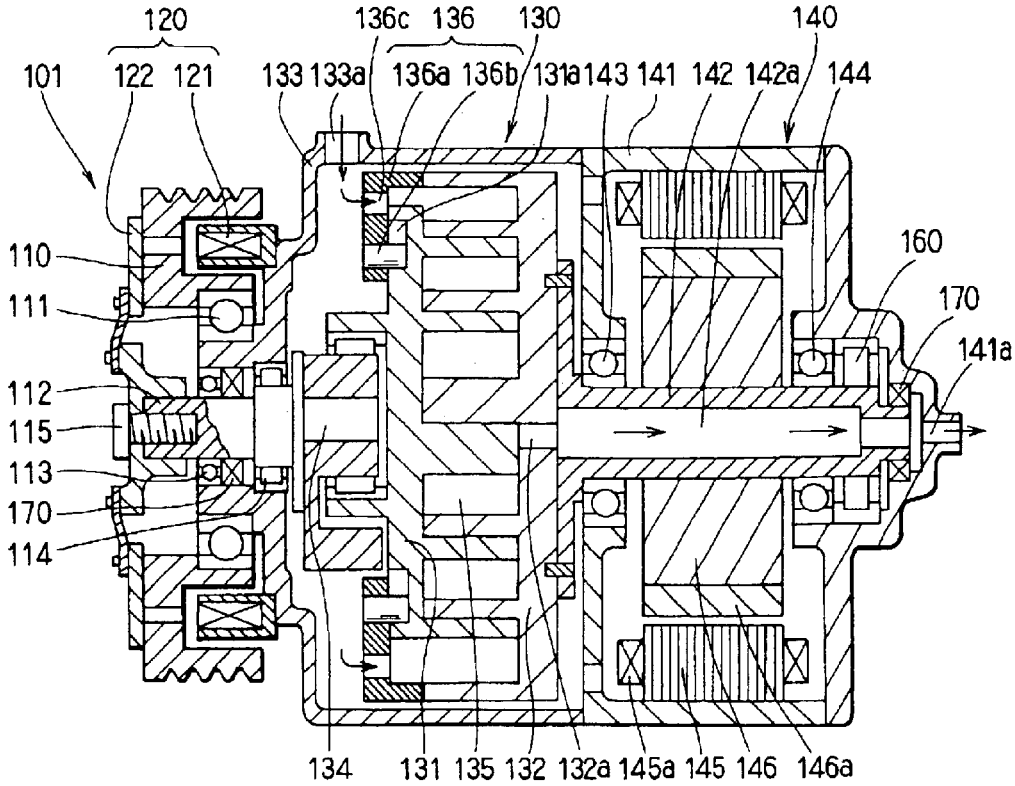
FIG. 2 is a cross sectional view of a hybrid compressor of FIG. 1.
Figure 3:
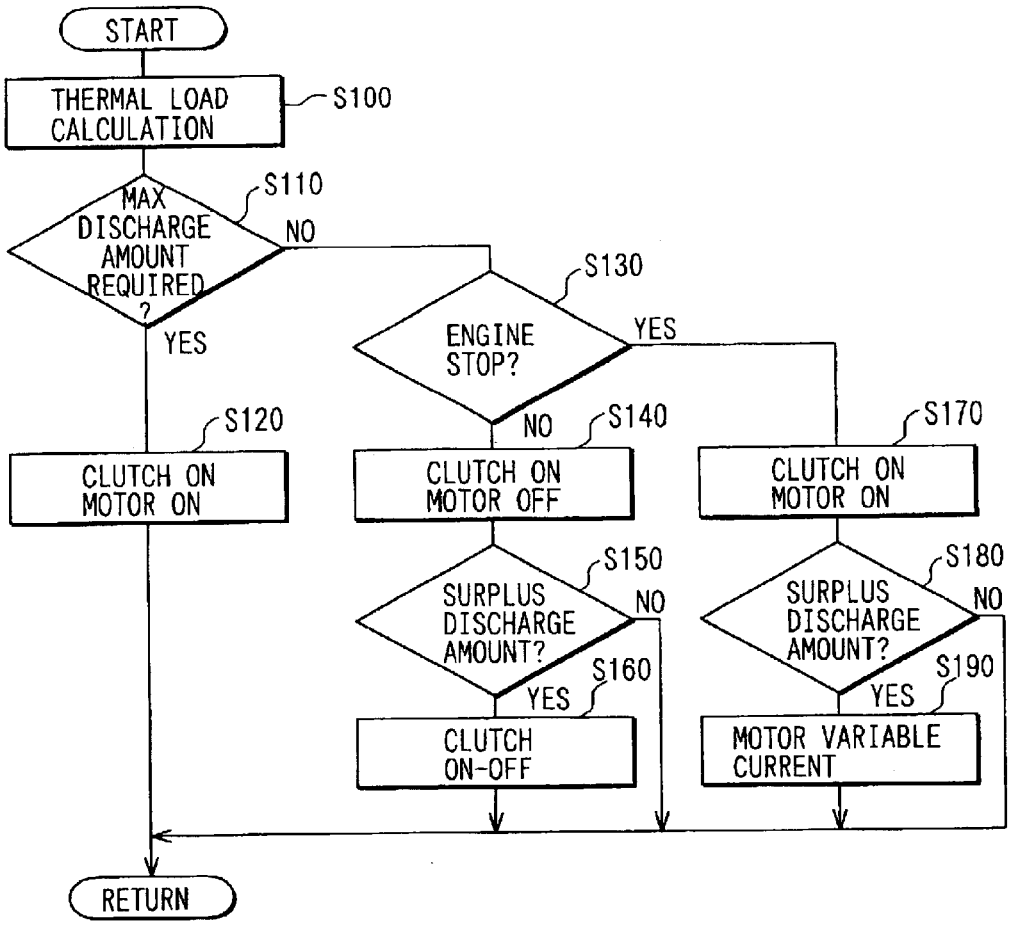
FIG. 3 is a flow chart showing controls of an electromagnetic clutch and a motor according to the first embodiment.

As shown in FIG. 2, a pulley bearing 111 provided in a compressor housing 133 rotatably holds the pulley 110. The pulley 110 is provided in a center thereof with a rotating pulley shaft 112 that is held by bearings 113 and 114. The pulley 110 is driven to rotate by driving force of the engine 10 transmitted thereto through a belt 50 (refer to FIG. 1).

The electromagnetic clutch 120 serves to permit or interrupt transmission of the driving force of the engine 10 from the pulley 110 to the compressor 130. The electromagnetic clutch 120 is composed of a coil 121 fixed to the compressor housing 133 and a hub 122 connected to the rotating pulley shaft 112 by a bolt 115. The electromagnetic clutch 120 operates in a known manner. Upon energizing the coil 121, the hub 122 is attracted to the pulley 110 so that the driving force of the engine 10 is transmitted to the rotating pulley shaft 112 (clutch ON). On the other hand, upon de-energizing the coil 121, the hub 122 comes away from the pulley 110 so that the transmission of the driving force of the engine 10 is interrupted (clutch OFF).

The compressor 130 is a main component of the present invention. Abase unit of a fixed capacity type compressor whose discharge capacity per one rotation is constant, in particular, a base unit of a well known scroll compressor can be used as the compressor 130 in the first embodiment. According to the first embodiment, body size of the compressor 130 is smaller than that of the conventional compressor driven only by the pulley 110, since the compressor 130 is driven both by the pulley 110 and by the motor 140 according to values of thermal load required for the refrigeration cycle system 200. Capacity of the compressor 130, which is presumably driven only by the pulley 110 to meet the maximum thermal load, is remarkably smaller than that of the conventional compressor (about ½ to ⅓ compared to the conventional compressor).

A first movable scroll 131 as a first compression member and a second movable scroll 132 as a second compression member, which are in mesh with each other, are housed inside the compressor housing 133. The first and second movable scrolls 131 and 132 can move independently of each other. The first movable scroll 131 is in slidable contact with an eccentric shaft 134 connected to the rotating pulley shaft 112 and revolves around the eccentric shaft 134 according to rotation of the eccentric shaft 134. Self-rotation of the first movable scroll 131 is prevented by a rotation preventing mechanism 136 composed of a main body **136*a* and a rotation preventing pin 136*b* in such a manner that the rotation preventing pin 136*b* is inserted into a guide groove 131*a* provided in the first movable scroll 131. The main body 136*a* of the rotation preventing mechanism 136 is in close contact with or fixed to an outer circumference of the second movable scroll 132 not to leak coolant within the first and second movable scrolls 131 and 132**.

The second movable scroll 132 is connected to a motor shaft (drive shaft) 142 of the motor 140 and is rotatable upon receiving a driving force of the motor 140.

The motor 140 is composed of a stator (fixed member) 145 having a coil 145*a* fixed to an inner circumference of a motor housing 141 and a rotor (rotating member) 146 fixed to the motor shaft 142 and provided at outer circumference thereof with a permanent magnet 146*a*. The motor shaft 142 is held by motor bearings 143 and 144 provided in the motor housing 141. The motor shaft 142 is provided inside with a hollow 142*a* through which coolant flows. When electric power is applied to the stator 145 from a battery 20 (refer to FIG. 1), the rotor 146 and the motor shaft 142 are driven to rotate.

A one-way clutch 160 is fixed to the motor housing 141 on an axial end side of the motor shaft (right end side in FIG. 2). When the motor 140 is driven upon receipt of the electric power of the battery 20, the one-way clutch 160 serves to permit the motor shaft 142 to rotate only in an opposite rotating direction to the pulley 110. That is, when the motor shaft 142 is to rotate in the same rotating direction to the pulley 110, the motor shaft 142 is engaged with the one-way clutch 160 so that its rotation is prevented.

The coolant in the refrigeration cycle system 200 flows into the compressor 130 from an intake port 133*a* provided in the compressor housing 133, then, into a compression chamber 135 from intake bores 136*c* provided in the rotation preventing mechanism 136 and compressed by relative movement of the first and second movable scrolls 131 and 132. Then, the compressed coolant is discharged via a discharge bore 132*a* provided in the second movable scroll 132 and the hollow 142*a* of the motor shaft 142 from a discharge port 141*a* provided in the motor housing 141.

To prevent leakage of the coolant from the compressor housing 133 to an outside on a side of the pulley 110 and from the motor housing 141 to an outside on a side of the axial end of the motor shaft 142, seal devices 170 are provided between the bearings 113 and 114 and between the discharge port 141*a* and the one-way clutch 160.

As shown in FIG. 1, various signals such as an engine revolution signal from the revolution sensor 40, an A/C demand signal and a temperature signal from an evaporator temperature sensor 231 are input to the control device 150. The control device 150 judges the thermal load of the refrigeration cycle system 200 based on the signals input thereto and controls both of the on/off operations of the electromagnetic clutch 120 and the operation of the motor 140 according to vehicle traveling conditions. The control device 150 is provided with a supply power control unit (for example, transistors and pulse controllers) in which the electric power to be supplied to the motor 140 is variably controlled so that the revolution number of the motor 140 is variable.

Operations of the control device 150 and the hybrid compressor 101 are described below. Controls of the electromagnetic clutch 120 and the motor 140 by the control device 150 are described at first with reference to a flowchart shown in FIG. 3.

After the engine 10 starts and the refrigeration cycle system 200 is operated, the thermal load of the refrigeration cycle system 200 is calculated at Step S100 based on the difference between the evaporator backside air temperature Te and the target temperature. At Step S110, whether the maximum discharge amount of the compressor 130 is necessary or not is determined. At the cool down time when the thermal load of the refrigeration cycle device 200 shows the maximum value, typically, just after starting the vehicle in summer time, the maximum discharge amount is necessary. In this case, at Step S120, the electromagnetic clutch 120 is turned on and the motor 140 is operated.

When the answer of the determination is negative at Step S110 and it is determined at Step S130 based on the engine revolution that the engine 10 does not stop and is still running, that is, at a normal traveling time, typically, after the cool down time, the electromagnetic clutch 120 is turned on and the operation of the motor 140 is stopped. Further, when it is determined at Step S160 that the discharge amount is surplus relative to the thermal load at that time, it is executed at Step S160 that the electromagnetic clutch 120 is repeatedly turned on and off to vary the discharge amount according to on and off repetition frequency.

When it is determined at Step S130 that the engine stops with the temporary stop of the vehicle during its traveling (idle stop), it is executed at Step S140 that the electromagnetic clutch 120 is turned on and the motor is operated. Then, when it is determined at Step S180 that the discharge amount is surplus relative to the thermal load at that time, it is executed at Step S190 that an amount of power supply from the battery 20 to the motor 140 is controlled to vary the discharge amount according to the revolution number of the motor 140.

Detail operation of the compressor 130 by the control device 150 is described with reference to FIGS. 4 and 5.

Figure 4:
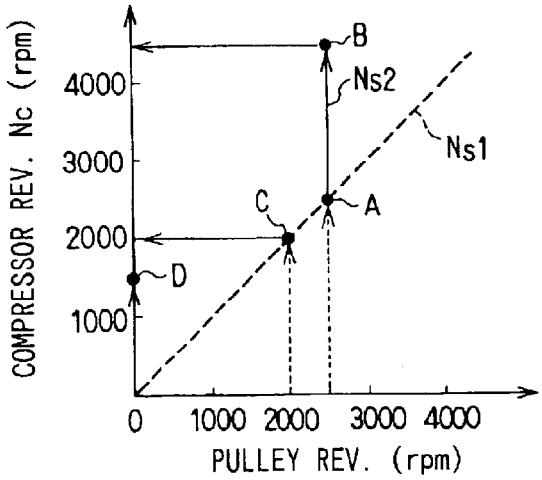
FIG. 4 is a characteristic graph showing a relationship among compressor revolution, pulley revolution and motor revolution according to the first embodiment.
Figure 5:
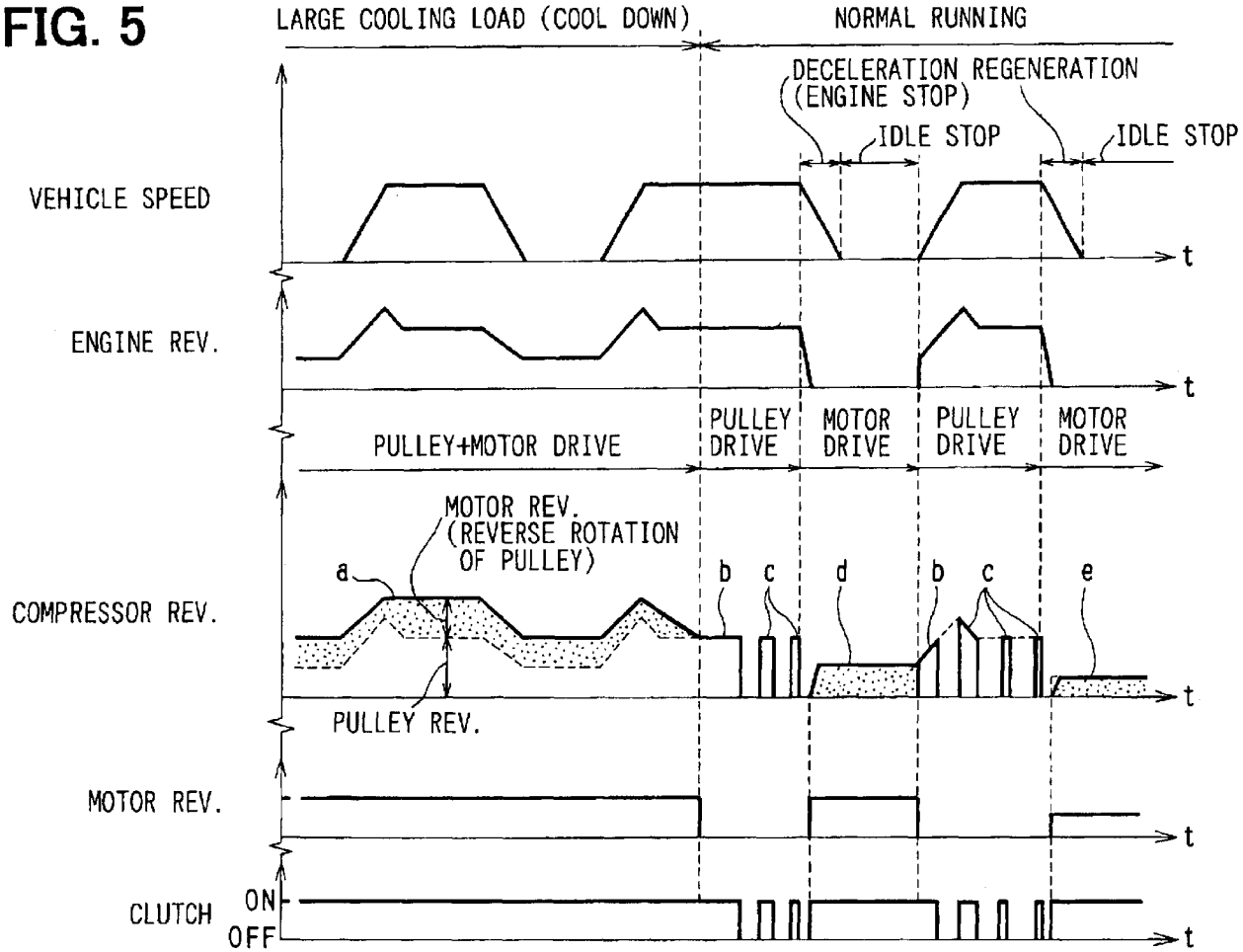
FIG. 5 is a time chart showing relationships among vehicle speed, engine revolution, the compressor revolution, the motor revolution and on/off operation of an electromagnetic clutch according to the first embodiment.

FIG. 4 is a characteristic graph showing a revolution number of the compressor 130 that is decided as a sum of the revolution number of the pulley 110 and the revolution number of the motor 140. The revolution number Nc of the compressor 130 is a revolution number of the first movable scroll 131 relative to the second movable scroll 132 since the first and second movable scrolls 131 and 132 are moved independently of each other. Therefore, the revolution number Nc of the compressor 130 is equal to the revolution number Ns1 of the first movable scroll 131 minus the revolution number Ns2 of the second movable scroll 132. As the rotation direction of the second movable scroll 132 is opposite to that of the first movable scroll 131, the revolution number Ns2 of the second movable scroll 132 is a minus number. Accordingly, a formula, Nc=Ns1−(−Ns2)=Ns1+Ns2, can be established.

In FIG. 4, a dotted line rising toward right at 45 degrees shows the revolution number Ns1 of the first movable scroll 131 to be driven by the pulley 110. The revolution number Nc of the compressor 130 is obtained by adding the revolution number Ns2 of the second movable scroll 132 to be driven by the motor 140 to the dotted line.

At the cool down time when the thermal load is maximum, the first movable scroll 131 rotates (revolves) according to the rotation of the pulley 110 upon turning on the electromagnetic clutch 120. At this time, it is presumed that the revolution number of the first movable scroll 131 is 2500 rpm (as shown by a point A in FIG. 4). If the motor 140 drives the second movable scroll 132 in a direction opposite to that of the pulley 110 and the revolution number of the second movable scroll 132 is presumed to be 2000 rpm, the revolution number of the compressor 130 increases to a value shown by a point B (Nc=2500+2000=4500 rpm) in FIG. 4 (refer to a mark a in a column of compressor revolution of FIG. 5).

At a normal running of the vehicle (for example, presuming that the rotation number of the puller 110 is 2000 rpm), if the electromagnetic clutch 120 is turned on and operation of the motor 140 stops, the revolution number of the second movable scroll 132 is zero and only the first movable scroll 131 rotates so that the compressor 130 is operated similarly as the conventional compressor. At this time, the revolution number Nc of the compressor 130 is 2000+0=2000 rpm, which is a value shown by a point C in FIG. 4 (refer to a mark c in a column of compressor revolution of FIG. 5).

When the first movable scroll 131 rotates, the one-way clutch 160 prevents the second movable scroll 132 from rotating along with the first movable scroll 131. The operation frequency of the first movable scroll 131, that is, the operation frequency of the compressor 130, is adjusted by changing frequency of the on and off operation of the electromagnetic clutch 120 so that the discharge amount of the compressor 130 is variable (refer to a mark c in the column of compressor revolution of FIG. 5).

At the idle stop time when the pulley 100 stops with the stop of the engine (rotation number of the pulley 110 is zero), the electromagnetic clutch 120 is kept on but the first movable scroll 131 is not rotated. The second movable scroll 132 is driven by the motor 140 (presuming that rotation number of the motor is 1500 rpm), the compressor 130 is operated in the same manner as the first movable scroll 131 rotates relatively to the second movable scroll 132 so that the revolution number of the compressor 130 shows a value shown by a point D in FIG. 4 (refer to a mark d in the column of compressor revolution of FIG. 5). The revolution number of the compressor 130 can be controlled to change the coolant discharge amount by changing an amount of power supplied to the motor 140 (refer to a mark e in the column of the compressor revolution of FIG. 5).

Advantages of the hybrid compressor 100 according the first embodiment are described below.

Since the first and second movable scrolls 131 and 132 are operable independently of each other and driven to rotate in opposite directions by the pulley 110 and the motor 140, respectively, the revolution number Ns1 of the compressor 130 at a time of engine running is a sum of the revolution number Ns1 of the first movable scroll 131 and the revolution number Ns2 of the second movable scroll 132. Accordingly, the compressor 130 can compress the coolant at higher speed, compared to the conventional hybrid compressor driven only by the pulley, so that the discharge amount of coolant more increases, which causes the compressor 130 more compact and lighter.

When the engine 10 stops, the motor 140 drives the second movable scroll 132, while the pulley 110 and the first movable scroll 131 stop, so that the first movable scroll 131 rotates relatively to the second movable scroll 132. Accordingly, the compressor 130 can continue the cooling operation of the refrigeration cycle system 200.

Further, when the pulley 110 rotates the first movable scroll 131 in a state that the motor 140 is not operated, the compressor 130 can operate in the same way as the conventional compressor, since the one-way clutch 160 prevents the second movable scroll 132 from rotating along with the first movable scroll 131.

Since the induced current is not generated in the motor 140, the driving force of the engine 10 is less consumed and the induced current control of the motor 140 for the motor generator 30 is not necessary.

Further, the discharge amount of the compressor 130 is variable by controlling the operation frequency of the compressor 130, since the driving force transmission of the pulley 110 to the first movable scroll 131 can be interrupted by the electromagnetic clutch 120 disposed between the pulley 110 and the first movable scroll 131.

As mentioned above, the discharge amount of the compressor 130 is changed by controlling the operation of the motor 140 and the on/off operation of the electromagnetic clutch 120. Accordingly, a fixed discharge capacity type compressor, which has no variable capacity mechanism, can be employed as the compressor 130 so that the compressor 130 is inexpensive.

Furthermore, in the motor 140 having the stator 145 and the rotor 146, the stator 145 has the coil 145*a*. Power of the battery 20 is applied directly to the coil 145 without a power transmission interface such as a slip ring so that a construction of the motor 140 is simple and inexpensive.

Figure 6:
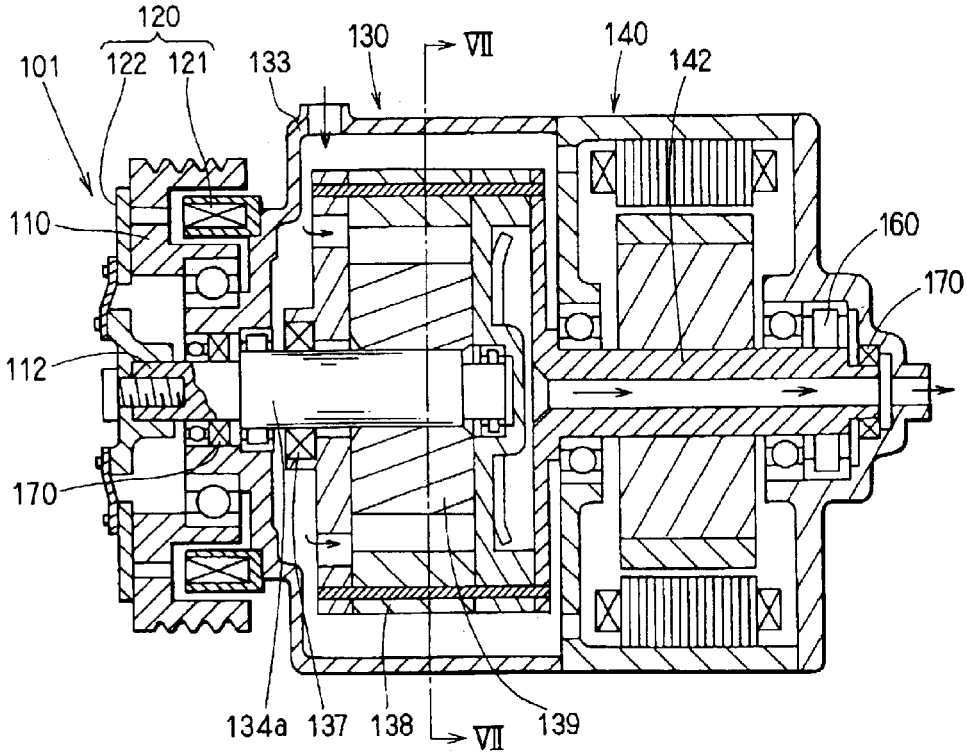
FIG. 6 is a cross sectional view of a modification of the hybrid compressor according to the first embodiment.
Figure 7:
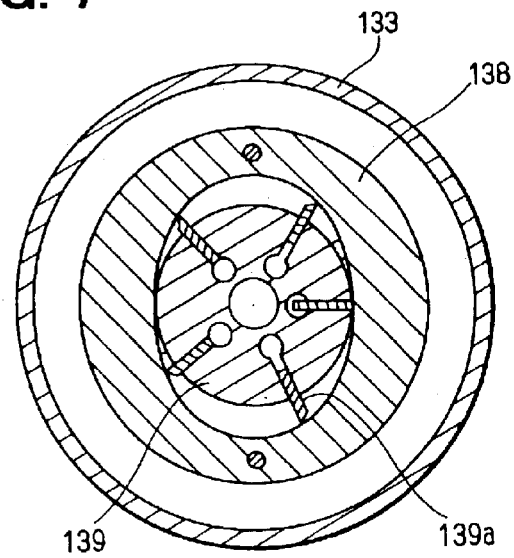
FIG. 7 is a cross sectional view taken along a line VII—VII of FIG. 6.

Moreover, instead of the fixed capacity type scroll compressor, a vane type compressor, in which the first compression member is a rotor having vanes 139*a* (fixed to a shaft 134*a* held by a bearing 137) and the second compression member is a rotary cylinder 138, as shown in FIGS. 6 and 7, may be applied to the compressor 130 according to the first embodiment.

(Second Embodiment)

Figure 8:
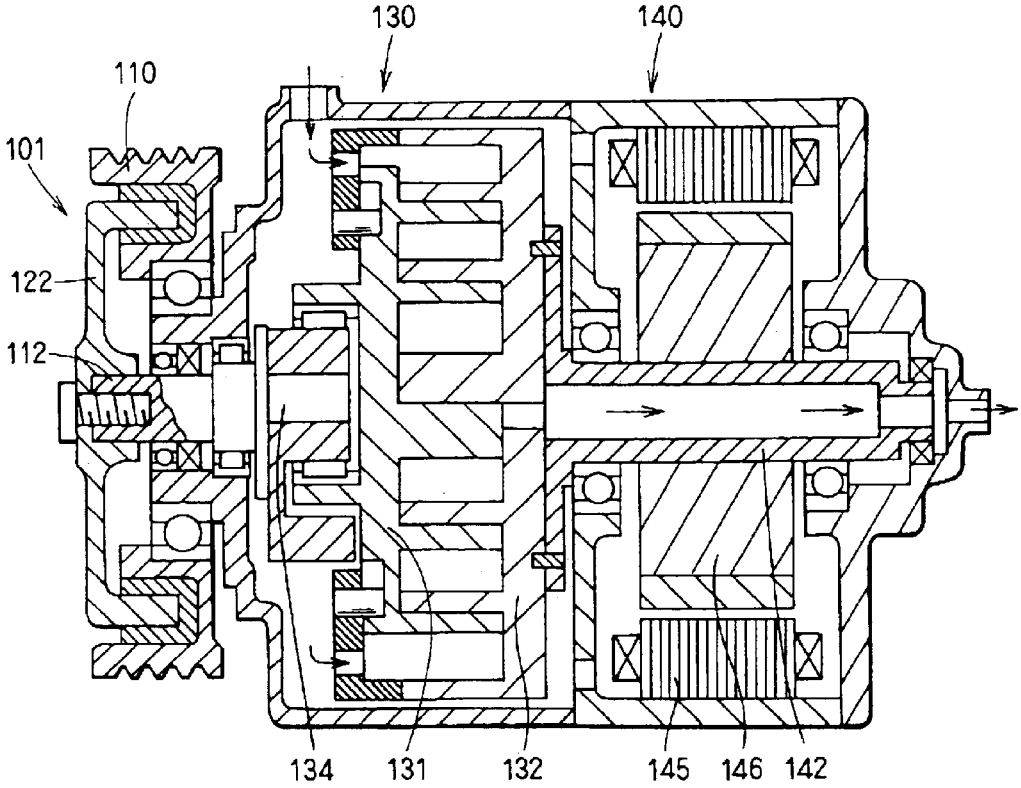
FIG. 8 is a cross sectional view of a hybrid compressor according to a second embodiment.

A hybrid compressor according to a second embodiment is described with reference to FIGS. 8 and 9.

According to the second embodiment, the electromagnetic clutch 120 is not provided between the pulley 110 and the first movable scroll 131 and the pulley 110 is directly connected to the hub 120. Further, the one-way clutch 160 is not provided on an axial end side of the rotating motor shaft 142.

Accordingly, induced current is generated in a motor 140 since the second movable scroll 132 is rotated along with the first movable scroll 131 that is driven by the pulley 110. The control device 150 controls the rotation amount of the second movable scroll 132 rotatable along with the first movable scroll 131.

Figure 9:
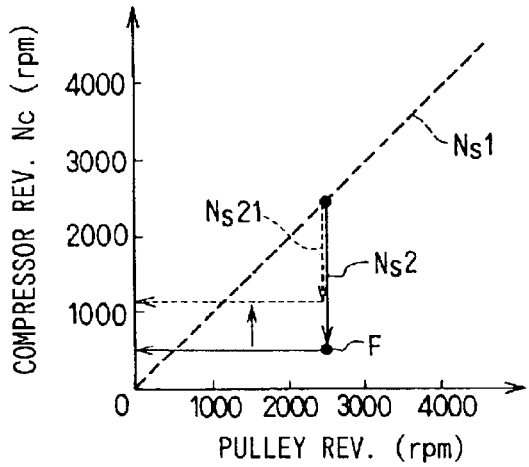
FIG. 9 is a characteristic graph showing a relationship among compressor revolution, pulley revolution and motor revolution according to the second embodiment.

The second movable scroll 132 rotates in the same direction as the first movable scroll 131 so that the revolution number Nc of the compressor, which is the revolution number Ns1 (presumably, 2500 rpm) of the first movable scroll 131 relative to the revolution number Ns2 (presumably, 200 rpm) of the second movable scroll 132, is equal to a value shown by a point F in FIG. 9 which is obtained by deducting the revolution number Ns2 from the revolution number Ns1.

If current is forcibly supplied to the motor 140 from the battery 20 to adjust the induced current generated in the motor 140 during a period when the second movable scroll 132 is rotated along with the first movable scroll 131, the current arouses a resistance acting against the rotation of the second movable scroll 132 along with the first movable scroll 131 so that the revolution number Ns2 of the second movable scroll 132 decreases and becomes revolution number Ns 21, resulting in decreasing the revolution number Nc of the compressor. That is, the discharge capacity of the compressor 130 can be variably controlled without providing the electromagnetic clutch 120 by adjusting the induced current generated in the motor 140.

The hybrid compressor or the hybrid compressor apparatus according to the first and second embodiments is applicable not only to the vehicle having the idle stop mechanism but also to a hybrid vehicle.

What is claimed is:

1. A compressor having independently driven members comprising:

first and second compression members, which are movable independently of each other, wherein a compression space is formed between the first compression member and the second compression member, and wherein fluid is compressed by varying a volumetric capacity of the compression space according to rotation of the first compression member relative to the second compression member;

a motor, which is rotatable upon receipt of power of an external electric source, wherein the motor is operatively connected to the second compression member; and a driven member rotatably driven by motive force transmitted from an external driving source, wherein the driven member is operatively connected to the first compression member, and wherein the rotating direction of the motor is opposite to that of the driven member.

2. A compressor having independently driven members according to claim 1, wherein the motor comprises a stator, a rotor, a motor shaft connecting the rotor and the second compression member and a one-way clutch provided on the motor shaft for allowing the motor shaft to rotate only in a rotating direction opposite to that of the driven member.

3. A compressor having independently driven members according to claim 1, further comprising an electromagnetic clutch provided between the first compression member and the driven member to permit or interrupt power transmission between the first compression member and the driven member.

4. A compressor having independently driven members according to claim 1, wherein the compressor is of a fixed capacity type in which a discharge capacity per rotation of the first compression member relative to the second compression member is constant.

5. A compressor having independently driven members according to claim 1, wherein the motor comprises a rotor and a stator on which a coil is wound.

6. A compressor having independently driven members according to claim 1, wherein the first and second compression members are first and second movable scrolls in mesh and coupled with each other, the first movable scroll having a guide groove, and wherein the driven member has an eccentric shaft in slidable contact with the first movable scroll, and wherein the compressor further comprises a rotation preventing mechanism having a main body fixed to the second movable scroll and a projection pin inserted into the guide groove, the rotation preventing mechanism causing the first movable scroll to revolve around the eccentric shaft without self-rotating according to rotation of the eccentric shaft.

7. A compressor having independently driven members comprising:

first and second compression members, which are movable independently of each other, wherein a compression space is formed between the first compression member and the second compression member, and wherein fluid is compressed by varying a volumetric capacity of the compression space according to rotation of the first compression member relative to the second compression member;

a motor, which is rotatable upon receipt of power of an external electric source, wherein the motor is operatively connected to the second compression member;

a driven member rotatably driven by motive force transmitted from an external driving source, wherein the driven member is operatively connected to the first compression member; and a control device for controlling operation of the motor, wherein, when the driven member drives the first compression member, the motor is driven separately by the control device so that the second compression member is rotated in a direction opposite to that of the first compression member.

8. A compressor having independently driven members comprising:

first and second compression members, which are movable independently of each other, wherein a compression space is formed between the first compression member and the second compression member, and wherein fluid is compressed by varying a volumetric capacity of the compression space according to rotation of the first compression member relative to the second compression member;

a motor, which is operatively connected to the second compression member;

a driven member rotatably driven by motive force transmitted from an external driving source, wherein the driven member is operatively connected to the first compression member; and a control device for controlling operation of the motor, wherein, when the driven member drives the first compression member, the second compression member is rotated along with the first compression member in the same rotating direction as that of the first compression member so that induced current is generated in the motor and, further, wherein the control device controls the induced current generated in the motor so that a rotation amount of the second compression member along with the first compression member is variable.

9. A compressor having independently driven members comprising:

first and second compression members, which are movable independently of each other, wherein a compression space is formed between the first compression member and the second compression member, and wherein fluid is compressed by varying a volumetric capacity of the compression space according to rotation of the first compression member relative to the second compression member;

a motor operatively connected to tile second compression member;

a driven member rotatably driven by motive force transmitted from an external driving source and operatively connected to the first compression member; and a control device for controlling operation of the motor, so that the motor is driven by electric power from an external electric source to rotate in a direction opposite to that of the fist compression member, when a fluid compression efficiency is increased, and so that the motor is driven by the second compression member to rotate in the same direction as the first compression member, when a fluid compression efficiency is decreased, wherein the motor is operated as an electric generating means.

10. A compressor having independently driven members comprising:

first and second compression members, which are movable independently of each other, wherein a compression space is formed between the first compression member and the second compression member, and wherein fluid is compressed by varying a volumetric capacity of the compression space according to rotation of the first compression member relative to the second compression member;

an electric rotating means operatively connected to the second compression member;

a driven member rotatably driven by motive force transmitted from an external driving source and operatively connected to the first compression member; and a control device for controlling operation of the electric rotating means, so that a relative rotational speed of the driven member with respect to the second compression member is controlled by varying a rotational direction as well as a rotational speed of the electric rotating means.

* * * * *